US005960764A

United States Patent [19]

Araki

[11] Patent Number: 5,960,764

[45] Date of Patent: Oct. 5, 1999

[54] FOUR-STROKE INTERNAL COMBUSTION ENGINE

[75] Inventor: Tsuneo Araki, Hinode-machi, Japan

[73] Assignee: Kioritz Corporation, Tokyo, Japan

[21] Appl. No.: 09/033,910

[22] Filed: Mar. 3, 1998

[30] Foreign Application Priority Data

Mar. 3, 1997 [JP] Japan ..... 9-047624

[51] Int. Cl.[6] ..... F01M 9/00

[52] U.S. Cl. ..... 123/196 R; 123/196 M; 123/196 CP; 184/6.5; 184/6.2; 184/6.9

[58] Field of Search ..... 123/196 R, 196 M, 123/196 CP; 184/6.2, 6.5, 6.8, 6.9, 6.26

[56] References Cited

U.S. PATENT DOCUMENTS

| | | | |
|---|---|---|---|
| 2,959,164 | 11/1960 | Janeway et al. | 123/73 A |
| 3,931,812 | 1/1976 | Ashfield et al. | 123/73 S |
| 5,582,145 | 12/1996 | Aizawa et al. | 123/196 CP |
| 5,709,185 | 1/1998 | Aizawa et al. | 123/196 R |
| 5,755,194 | 5/1998 | Moorman et al. | 123/196 W |

FOREIGN PATENT DOCUMENTS 8-260926 10/1996 Japan .

*Primary Examiner*—Henry C. Yuen
*Assistant Examiner*—Hai Huynh
*Attorney, Agent, or Firm*—Thelen Reid & Priest LLP

[57] ABSTRACT

A four-stroke internal combustion engine in accordance with the present invention comprises a piston, a valve chamber, a crankcase, an oil chamber separated from the crankcase, and an oil mist feeding passage extending from the oil chamber to the crank case via the valve chamber for supplying oil mist in the oil chamber. The oil mist feeding passage has a first passage extending from the oil chamber to the valve chamber, a second passage extending from the valve chamber to the crankcase, and a third passage extending from the crankcase to the first passage. The first passage has a first opening directed toward the oil chamber. The second passage has a second opening directed toward the crankcase located at a point where it can be closed by the piston when it travels downwardly. The third passage has a third opening directed toward the crankcase located at a point below a bottom dead center of the piston. The engine further comprises a first check valve provided in the oil chamber and which allows atmospheric air to flow into the oil chamber, and a second check valve provided in the valve chamber and which allows gas to flow toward an intake side of a carbureter.

2 Claims, 4 Drawing Sheets

FOUR-STROKE INTERNAL COMBUSTION ENGINE

BACKGROUND OF THE INVENTION

The present invention relates to a four-stroke internal combustion engine which is suitable for use in a portable working apparatus such as a portable trimmer.

DESCRIPTION OF THE PRIOR ART

In order to improve a recent air pollution problem, there is a demand to utilize a four-stroke internal combustion engine for a portable working apparatus such as a portable trimmer for which a two-stroke internal combustion engine has been conventionally used. During operation, such a portable trimmer may take a horizontal orientation or an inclined orientation in addition to an upright orientation. Therefore, there is a possibility that the lubrication oil stored in an oil chamber (oil pan) excessively flows into the crankcase and the valve chamber. Conventionally, to prevent such an excess supply of the oil, a four-stroke engine whose oil chamber and crankcase are separated from each other by a bulkhead were developed.

For example, in a four-stroke internal combustion engine disclosed in Japanese Patent Laid-open Disclosure No. 8-260926, a crankcase and an oil chamber located under a crankcase are separated from each other by a bulkhead so that oil in the oil chamber does not flow into the crankcase and the valve chamber even if the engine takes a horizontal orientation or an inclined orientation. The four-stroke internal combustion engine has a conduit which protrudes a predetermined length into the oil chamber and communicates the oil chamber with the valve chamber, an opening which is directed toward the crankcase at a point where it is closed when a piston travels downwardly and communicates the valve chamber with the crankcase, and a reed valve which opens when the crankcase is under a positive pressure created by downward motion of the piston. Further, a check valve which allows exhausting from inside to outside is provided in the valve chamber. When the piston of the engine is in downward motion, the opening is closed thereby. Further, when the reed valve opens due to the positive pressure created in the crankcase, oil mist including blowby-gas which exists in an upper space of the oil chamber is pumped into the valve chamber via the conduit. Furthermore, gas separated from the oil is discharged toward an air cleaner via the check valve. Subsequently, when the piston travels upwardly, the opening directed toward the crankcase opens and the oil mist is sucked from the valve chamber into the crankcase due to negative pressure created in the crankcase. Then, when the piston travels downwardly creating the positive pressure in the crankcase, the reed valve opens and the oil mist in the crankcase returns to the oil chamber. At the same time, the oil mist in the oil chamber is pumped into the valve chamber. As stated hereabove, in the four-stroke internal combustion engine, the oil mist is circulated through an oil circulating passage extending from the oil chamber through the valve chamber and the crankcase back to the oil chamber per every cycle of the up and down motion of the piston.

SUMMARY OF THE INVENTION

It is, therefore, an object of the present invention to provide a four-stroke internal combustion engine having a bulkhead for separating the crankcase from the oil chamber, and which feeds oil mist to mechanical parts of the engine for lubrication by utilizing different means from the conventional engine.

The above object of the present invention can be accomplished by a first aspect of the invention of a four-stroke internal combustion engine, comprising: a piston; a valve chamber; a crankcase; an oil chamber separated from the crankcase; an oil mist feeding passage extending from the oil chamber to the crank case via the valve chamber for supplying oil mist in the oil chamber; the oil mist feeding passage having a first passage extending from the oil chamber to the valve chamber, a second passage extending from the valve chamber to the crankcase, and a third passage extending from the crankcase to the first passage; the first passage having a first opening directed toward the oil chamber, the second passage having a second opening directed toward the crankcase and located at a point where it can be closed by the piston when it travels downwardly, and the third passage having a third opening directed toward the crankcase located at a point below a bottom dead center of the piston; a first check valve provided in the oil chamber and which allows atmospheric air to flow into the oil chamber, and a second check valve provided in the valve chamber and which allows gas to flow toward an intake side of a carbureter.

The engine in accordance with the first aspect of the invention functions as follows. When the piston is located at a lower location, the second opening is closed thereby. When the piston travels upwardly, the second opening directed toward the crankcase opens and the crankcase is under a negative pressure. It causes the oil mist in the oil chamber to be supplied to the mechanical parts of the engine via the two passages. That is, the negative pressure causes the first check valve to open to allow the atmospheric air to flow into the oil chamber, whereby the oil mist in the oil chamber is sucked into the valve chamber via the first opening and the first passage. It is further sucked into the crankcase via the second passage and the second opening. Further, the negative pressure causes the oil mist in the oil chamber to be sucked into the crankcase via the third passage. It enables to lubricate the mechanical parts in the valve chamber, the piston and the cylinder during the upward motion of the piston.

Subsequently, when the piston travels downwardly, the second opening is closed thereby again and the crankcase is under a positive pressure. It causes the air containing oil mist in the crankcase to be pumped into the valve chamber through the third opening, the third passage and the first passage. Further, the gas containing blowby-gas which is separated from the oil is exhausted toward the carbureter via the second check valve.

Subsequently, when the piston travels upwardly, the second opening opens again and the crankcase is under negative pressure. As stated above, it causes the oil mist to be supplied to the valve chamber via the oil chamber and the first passage. The air containing residual oil left in the valve chamber is sucked into the crankcase via the second passage and the second opening. The oil mist is also fed directly into the crankcase via the first opening and the third passage.

In a second aspect of the present invention, a four-stroke internal combustion engine comprises: a connecting rod; a valve chamber; a crankcase; an oil chamber separated from the crankcase by a bulkhead provided therebetween, a slit being formed in the bulkhead; an oil dipper provided at a big end of the connecting rod, for agitating oil stored in the oil chamber passing through the slit for lubrication; an oil mist feeding passage extending from the oil chamber to the crank case via the valve chamber for supplying oil mist in the oil chamber; the oil mist feeding passage having a first passage extending from the oil chamber to the valve chamber, and a second passage extending from the valve chamber to the crankcase; the first passage having a first opening directed toward the slit in the oil chamber, the second passage having a second opening directed toward the crankcase located at a point where it can be closed by a piston when it travels downwardly, a first check valve provided in the oil chamber and which allows atmospheric air to flow into the oil chamber, and a second check valve provided in the valve chamber and which allows gas to flow toward a carbureter.

The engine in accordance with the second aspect of the invention functions as follows. By the movement of the connecting rod driven by the reciprocating motion of the piston, the oil dipper provided at a tip end of the big end of the connecting rod projects into oil stored in the oil chamber through the slit formed in the bulkhead or retracts into the crankcase. When the oil dipper projects out through the slit, it makes contact with the oil in the oil chamber and agitates the oil to lubricate the mechanical parts in the crankcase.

Further, when the piston travels downwardly, the second opening is closed thereby. Subsequently, as the piston travels upwardly, the second opening opens and the crankcase is under negative pressure which causes the oil mist to be fed to the mechanical parts of the engine through the two passages. That is, the negative pressure causes the first check valve provided in the oil chamber to open to allow the atmospheric air to flow into the oil chamber as the oil mist is sucked into the valve chamber via the first opening directed toward the slit and the first passage, and further through the second passage and the second opening. Further, the negative pressure causes the oil mist in the oil chamber to be sucked directly into the crankcase via the slit formed in the bulkhead. It is to be noted that in the engine in accordance with the second aspect of the invention, because the oil is agitated by the oil dipper, the oil mist in the vicinity of the slit is condensed. Therefore, the condensed oil mist can be fed to the mechanical parts of the engine via the first opening and the slit.

Subsequently, as the piston travels downwardly, the second opening is closed thereby and the crankcase is under positive pressure. It causes the air containing the oil in the crankcase to be pumped into the oil chamber via the slit. It is further pumped into the valve chamber with the oil mist in the oil chamber via the first opening and the first passage. Further, the gas including the blowby-gas separated from the oil is exhausted toward the carbureter via the second check valve provided in an oil separating chamber communicated with the valve chamber.

Subsequently, as the piston travels upwardly, the second opening opens and the crank case is under negative pressure. It causes the first check valve to open, which allows the atmospheric air to flow into the oil chamber, whereby additional oil mist is fed from the oil chamber into the valve chamber via the first opening. The air containing residual oil left in the valve chamber is sucked into the crankcase via the second passage and the second opening. The oil mist in the oil chamber is also fed directly into the crankcase.

The above and other objects and features of the present invention will become apparent from the following description made with reference to the accompanying drawings.

DESCRIPTION OF THE PREFERRED EMBODIMENTS

Figure 1:
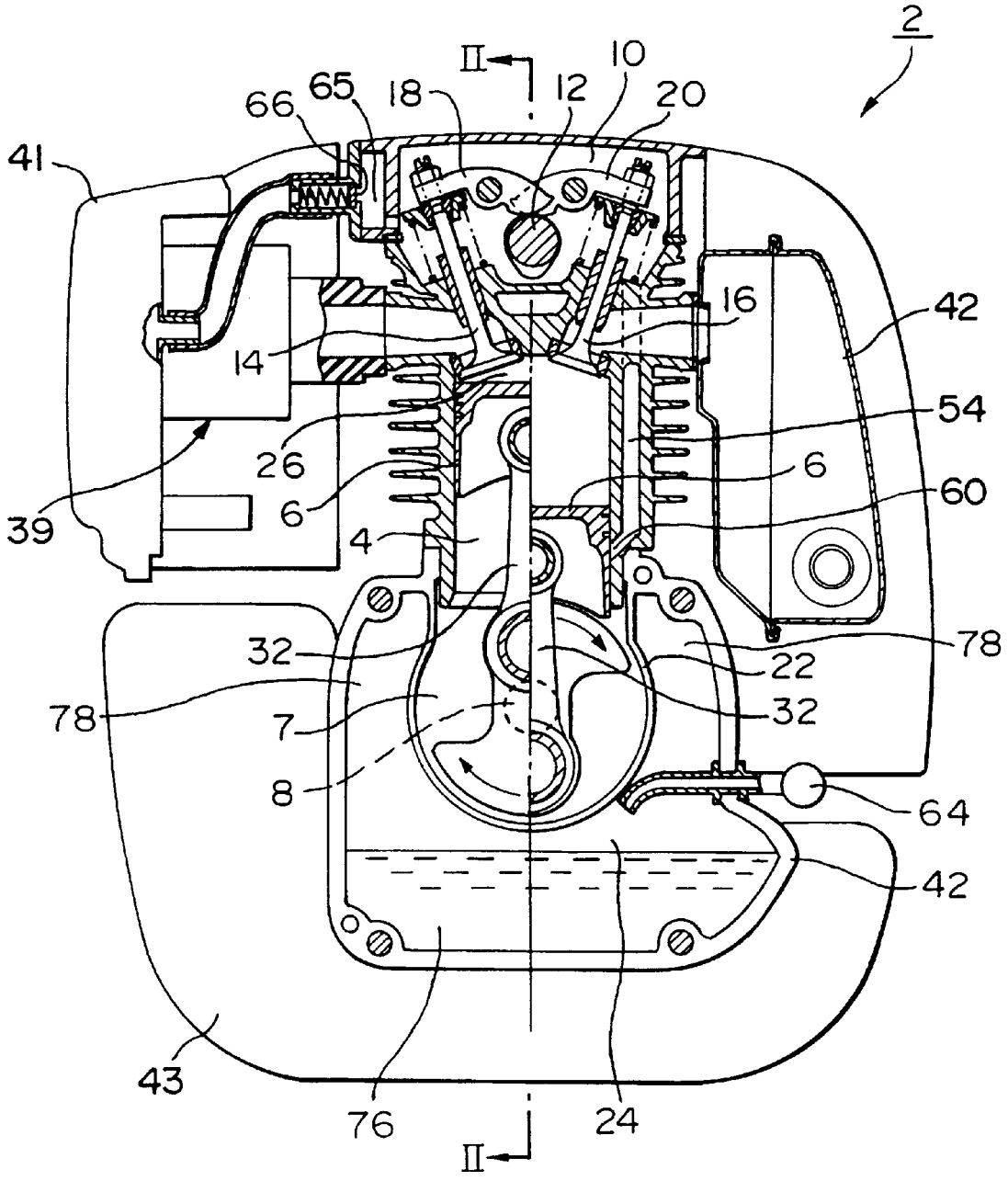
FIG. 1 is a cross-sectional view of a four-stroke internal combustion engine in accordance with a first embodiment of the present invention, with the piston shown at top dead center in the left half portion thereof, and with the piston shown at bottom dead center in the right half portion thereof.

A four-stroke internal combustion engine in accordance with the present invention is of an air-cooled type having one cylinder. Although it is not shown in the drawings, a portable trimmer comprises the four-stroke internal combustion engine, a supporting tube extending straight from the engine in a forward direction in which an output shaft extending from the engine is inserted, and a circular rotatable cutter provided at a forward end of the supporting tube and being rotatably driven by the engine. Since an operator carries out a trimming operation by carrying the portable trimmer by hand, the four-stroke internal combustion engine may take various positions such as an inclined, horizontal, or upside-down position. The four-stroke engine which is mounted on an apparatus such as the portable trimmer will be explained hereafter with reference to the attached drawings.

As shown in FIG. 1, the four-stroke internal combustion engine 2 comprises a cylinder 4, a piston 6 which travels up and down in the cylinder 4, and a crankshaft 8 which is disposed in a crankcase 7 located below the cylinder 4 and is rotated in a direction indicated by an arrow (in a clockwise direction) to transform up and down reciprocating motion of the piston 6 into rotational motion via a connecting rod 32. The engine 2 further comprises a valve chamber 10 provided above the cylinder 4 and an intake valve 14 communicating with an air cleaner 41 and a carbureter 39, and an exhaust valve 16 communicating with a muffler 42. A camshaft 12 rotatably driven by the crankshaft 8 and a pair of rocker arms 18, 20 which transmit rotational motion of the camshaft 12 to the valves 14, 16 are provided in the valve chamber 10. Further, an oil chamber 24 is separated from the crankcase 7 by a bulkhead 22.

The cylinder 4 is of a conventional cylindrical type within which the piston 6 travels up and down between a top dead center and a bottom dead center to compress air-fuel mixture introduced into a combustion chamber 26 provided above the cylinder 4 to a predetermined compression ratio. It is to be noted that in the left half portion of the engine shown in FIG. 1 and FIG. 2, the piston 6 has reached the top dead center whereas in the right half portion of the engine shown in FIG. 1, the piston 6 has reached the bottom dead center. Although it is not shown in the drawings, the supporting tube having the output shaft therein which is driven by the engine 2 via a centrifugal clutch 45 is connected to a forward end of the crankshaft 8 as viewed in FIG. 2. The cutter is mounted at the forward end of the output shaft. A recoil starter 44 for starting the engine 2 is mounted on a rear end of the crankshaft 8.

Figure 2:
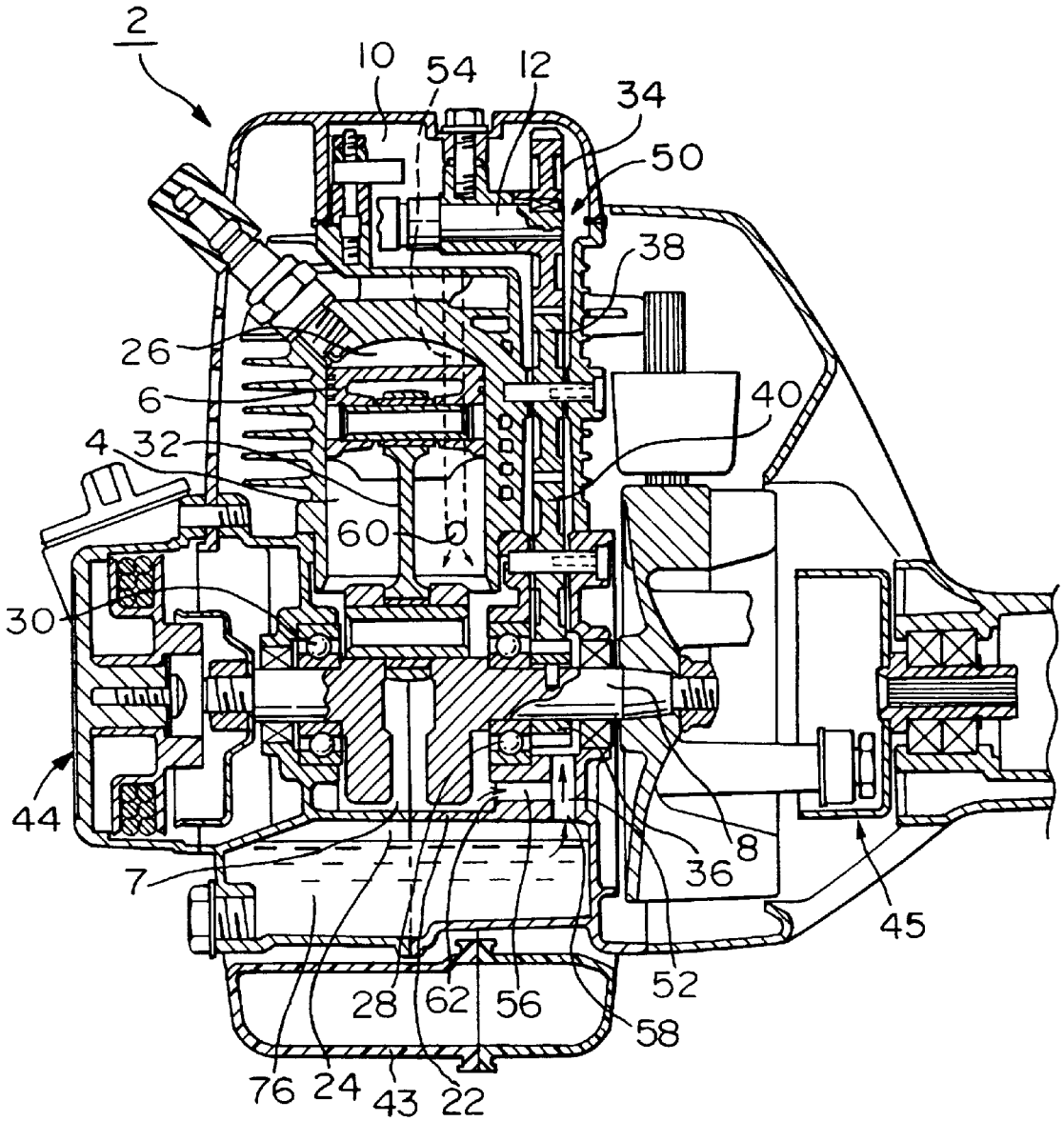
FIG. 2 is a cross-sectional view along a line II—II of the engine shown in FIG. 1.

As shown in FIG. 2, a camshaft gear 34 and a crankshaft gear 36 having a predetermined gear ratio are attached to the camshaft 12 and the crankshaft 8 respectively by a key or pin. A first gear 38 and second gear 40 are provided between the camshaft gear 34 and the crankshaft gear 36, whereby the rotational direction of the crankshaft is reversed to transmit torque of the crankshaft 8 to the camshaft 12. The first and second gears 38 and 40 are identical. The rotational speed of the crankshaft 8 is transmitted to the camshaft 12 at a speed half that of the crankshaft 8.

With reference to FIG. 1, the oil chamber 24 is defined by an inner wall 22 of the bulkhead which surrounds the connecting rod 32 on left, right and lower sides thereof to form the crankcase 7, an outer wall 42 which surrounds the inner wall 22, and upper ends thereof which are connected with the inner wall 22. The inner wall 22 and the outer wall 42 define an oil reserving area 76 under the crankcase 7 and oil relief areas 78 on the right and left sides of the crankcase 7. The volumes of each oil relief area 78 is of a size in which an entire amount of oil stored in the oil reserving area 76 can be accommodated. When the engine 2 is inclined, the oil within the oil reserving area 76 flows into one or both of the oil relief areas 78.

Further, as shown in FIG. 2, the engine 2 has an oil mist feeding passage 50 for supplying oil mist for lubricating various mechanical parts of the engine 2. The oil mist feeding passage 50 has a first passage 52 extending from the oil reserving chamber 24 to the valve chamber 10 via an area where the gears 34, 36, 38, and 40 are located, a tubular second passage 54 extending from the valve chamber 10 to the crankcase 7 straight in a downward direction, and a third passage 56 extending from a location in the crankcase 7 in the vicinity of a bottom wall surface in a horizontal direction and intersecting with the first passage 52. The first passage 52 is provided with a first opening 58 directed toward the oil chamber 24. The first opening 58 is located at the lowest point of the bottom of the inner wall 22 as can be understood from FIG. 2 so that the oil surface does not reach the first opening 58 when the oil flows from the oil reserving area 76 to one of the oil relief areas 78 by turning the engine 2 to the left and right about an elongated axis of the crankshaft 8. Further, the second passage 54 has a second opening 60 directed toward the crankcase 7 at a location where it can be closed by the piston 6 when it travels downwardly. The third passage 56 has a third opening 62 directed toward the crankcase 7 at a location lower than the bottom dead center of the piston 6. As shown in FIG. 1, the oil chamber 24 is provided with a first breather or first check valve 64 which allows the atmospheric air to flow into the oil chamber 24. Further, an oil separating chamber 65 communicating with the valve chamber 10 is provided with a second breather or second check valve 66 which allows gas containing blowby-gas to flow toward an intake side of the carbureter 39, i.e., toward the air cleaner 41.

The engine 2 in accordance with the first embodiment functions as follows. When the piston 6 is located at the bottom dead center shown in the right half portion of the engine 2 in FIG. 1, the second opening 60 is closed by the piston 6. When the piston 6 travels upwardly, the second opening 60 directed toward the crankcase 7 opens (see FIG. 1). During that time, the crankcase is under a negative pressure, which causes the first breather 64 in the oil chamber 24 to open, whereby the atmospheric air is allowed to flow into the oil chamber 24. It causes the oil mist which exists in an upper space within the oil chamber 24 is to be sucked into the valve chamber 10 through the first passage 52 via the first opening 58, whereby the oil mist is carried to each of the gears 34, 36, 38, 40 and other mechanical parts in the valve chamber 10. When the oil mist flows through the first passage 52, the oil adheres to each of the gears 34, 36, 38, 40 and a peripheral surface of the first passage 52. The oil adhered thereto is agitated by rotation of the gears 34, 36, 38, 40 in the upward direction so as to be delivered toward the valve chamber 10 whereby each of the gears 34, 36, 38, 40, the camshaft 12, the intake valve 14, the exhaust valve 16 and the rocker arms 18, 20 are lubricated.

Further, the oil mist is sucked into the crank chamber 7 via the second opening 60 via the second passage 54. Furthermore, oil in a liquid state collected in the valve chamber 10 flows into the crankcase 7 via the second passage 54 and is collected at a bottom of the crank case 7. At the same time, the oil mist in the oil chamber 24 is directly sucked into the crankcase 7 via the third opening 62 via the third passage 56.

Further, when the piston 6 travels downwardly, the second opening 60 is closed by the piston 6 again. During that time, the crankcase 7 is under a positive pressure, whereby the air containing the oil mist within the crankcase 7 is pumped into the third opening 62 and flows into the valve chamber 10 through the third passage 56 and the first passage 52. The gas containing the blowby-gas which is separated from the oil is exhausted toward the air cleaner 41 through the second breather 66 provided in the oil separating chamber 65 communicated with the valve chamber 10. The oil in the liquid state collected at the bottom of the crankcase 7 is pumped out therefrom through the third passage 56. Some oil flows into the oil chamber 24 via the first opening 58 and some oil is delivered upwardly toward the valve chamber 10 through agitation by the gears 34, 36, 38, 40 in the first passage 52.

Subsequently, when the piston 6 moves upwardly, the second opening 60 opens. During that time, the crankcase 7 is under negative pressure whereby additional oil mist is supplied from the oil chamber 24 to the valve chamber 10 through the first passage 52 and the air containing the residual oil mist in the valve chamber 10 is sucked into the crank case 7 via the second passage 54 and the second opening 60. Further, additional oil mist is supplied directly to the crankcase 7 via the first opening 58 and the third passage 56.

It is to be noted that the engine 2 in accordance with the first embodiment may be inclined considerably while the portable trimmer is manipulated. However, the oil stored in the oil reserving area 76 flows into one or both of the oil relief areas 78 and it prevents the oil from flowing into the first opening 58, because it is located where the oil surface does not reach as stated hereabove.

A four-stroke internal combustion engine 70 in accordance with a second embodiment of the present invention is constructed in the same way as the first embodiment except for the following points. A big end of the connecting rod 32 of the engine 70 according to the second embodiment is provided with an oil dipper 72 protruding straight along a center elongated axis of the connecting rod 32. A slit 74 is formed in the bottom portion of the inner wall 22 to allow the oil dipper 72 to pass therethrough. The oil dipper 72 moves in reciprocating motion driven by reciprocating motion of the connecting rod 32 to agitate the oil from the oil chamber 24 to lubricate various mechanical parts in the crankcase 7. The size of the slit 74 is determined to be the smallest size possible which allows the oil dipper 72 to agitate a predetermined amount of oil toward the crankcase 7 and the cylinder 6 without interference between the oil dipper 72 and the inner wall 22. The oil dipper 72 extends straight along the elongated center axis of the connecting rod 32 and therefore, the slit 74 is formed in symmetry with respect to the center elongated axis of the connecting rod 32 corresponding to a symmetrical locus of the motion thereof. The slit 74 extends in a horizontal direction at a center of the bottom portion of the inner wall 22 as viewed in the cross-sectional view in FIG. 3. Therefore, the oil surface does not reach the slit 74 even if the engine 70 is rotated in the right and left directions as viewed in FIG. 3. Thus, the oil does not flow into the crankcase 7 through the slit 74.

The purpose of providing the oil reserving area 76 below the crankcase 7 and the oil relief areas 78 on the right and left sides thereof which are defined by the inner wall 22 and the outer wall 42 is the same as the first embodiment. Each volume of the oil relief areas 78 is of a size in which the oil can be stored without flowing into the slit 74.

Figure 4:
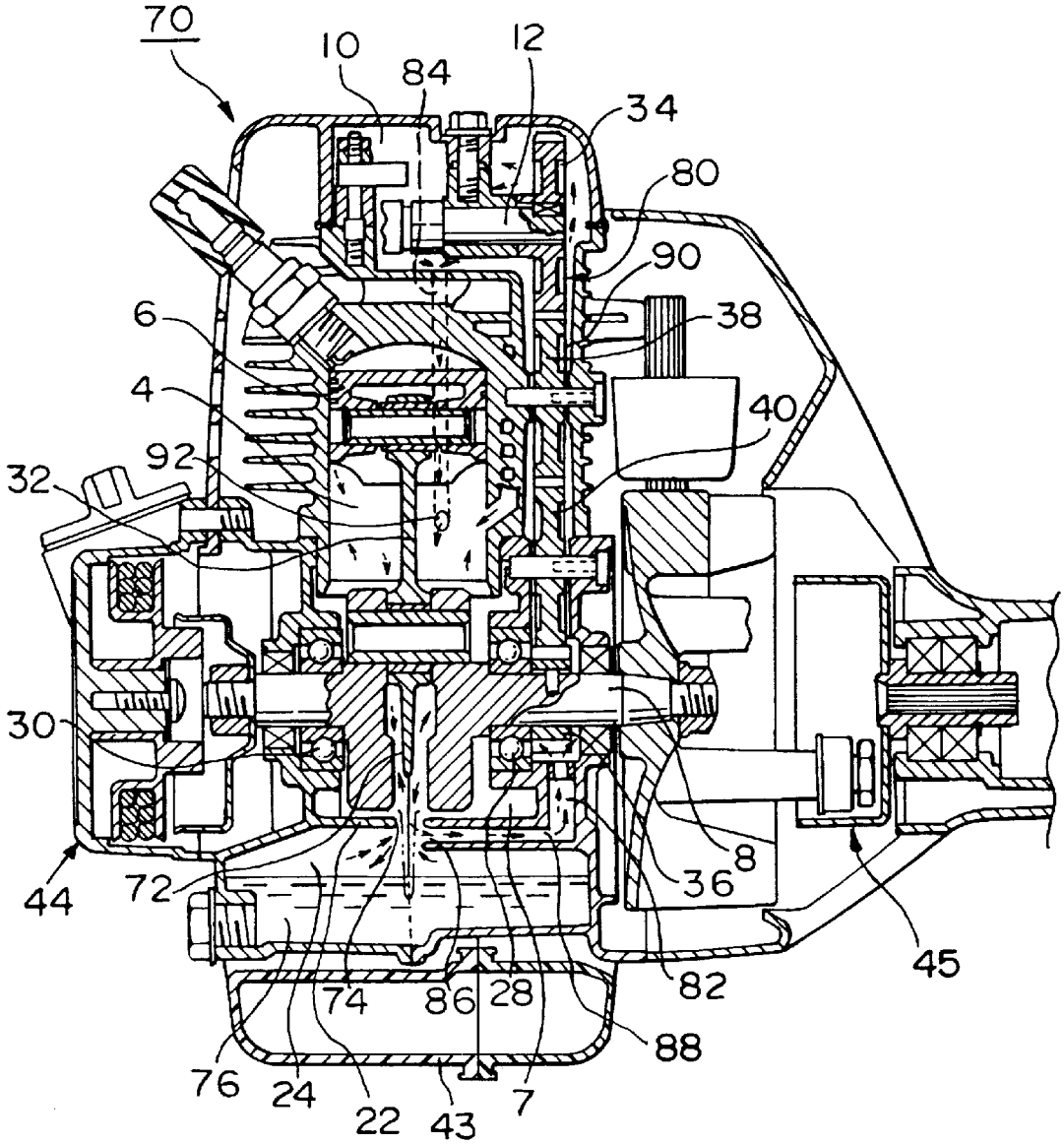
FIG. 4 is a cross-sectional view along a line IV—IV of the engine shown in FIG. 3.

As shown in FIG. 4, the engine 70 of the second embodiment has an oil mist feeding passage 80. The oil mist feeding passage 80 has a first passage 82 extending from a point in the vicinity of the slit 74 to the valve chamber 10 via the area where the gears 34, 36, 38, and 40 are located, and a second passage 84 extending from the valve chamber 10 to the crankcase 7 straight in a downward direction. The first passage 82 is provided with a tubular portion 88 extending from a point in the vicinity of the slit 74 along a lower surface of the inner wall 22 on the side of the oil chamber 24 in the horizontal direction and a vertical portion 90 extending straight in an upward direction via the area where the gears 34, 36, 38, 40 are provided. The tubular portion 88 has a first opening 86 directed toward the slit 74. The second passage 84 has a second opening 92 directed toward the crankcase 7 at a location where it can be closed when the piston 6 moves downwardly.

The engine 70 in accordance with the second embodiment functions as follows. The motion of the piston 6 causes the big end of the connecting rod 32 to move in rotational motion whereby the oil dipper 72 provided at the big end of the connecting rod 32 is protruded into the oil in the oil chamber 24 through the slit 74 and retracted into the crankcase 7. When the oil dipper 72 projects out, the tip portion thereof makes contact with the oil in the oil chamber 24 and splashes the oil into the crankcase 7 to lubricate the mechanical parts therein such as the piston 6. By agitation of the oil by the oil dipper 72, concentrated oil mist is created in the vicinity of the slit 74 in the oil chamber 24.

The oil mist is supplied to various mechanical parts of the engine 70 through the oil mist feeding passage 80 by the positive or the negative pressure caused by the up and down motion of the piston 6. That is, when the piston 6 is located at the bottom dead center shown in the right half portion of the engine 70 in FIG. 3, the second opening 92 is closed by the piston 6. When the piston 6 travels upwardly, the second opening 92 directed toward the crankcase 7 opens (see FIG. 4). During that time, the crankcase 7 is under a negative pressure which causes the first breather 64 in the oil chamber 24 to open to allow the atmospheric air to flow into the oil chamber 24. It causes the concentrated oil mist to be sucked into the valve chamber 10 through the tubular portion 88 and the vertical portion 90 of the first passage 82 via the first opening 86 directed toward the slit 74. Further, the oil adheres to each of the gears 34, 36, 38, 40 and the peripheral surface of the first passage 82 when the oil flows therethrough as in the first embodiment. Further, the oil mist is sucked into the crankcase 7 via the second opening 92 via the second passage 84. Furthermore, the oil in the liquid state collected in the valve chamber 10 flows into the crankcase 7 via the second passage 84 and returns to the oil chamber 24 via the slit 74. At the same time, the concentrated oil mist is sucked directly into the crankcase 7 via the slot 74. The parts such as the piston 6 are lubricated by the oil mist as well.

Further, when the piston 6 travels downwardly, the second opening 92 is closed thereby again. During that time, the crankcase 7 is under a positive pressure, whereby the air containing the oil mist within the crankcase 7 is pumped into the slit 74 and flows into the valve chamber 10 through the tubular portion 88 and the vertical portion 90 via the first opening 86. The gas containing the blowby-gas which is separated from the oil is exhausted toward the air cleaner 4 through the second breather 66 provided in the oil separating chamber 65 communicating with the valve chamber 10.

Subsequently, when the piston 6 moves upwardly, the second opening 92 opens. During that time, the crankcase 7 is under a negative pressure to cause the concentrated oil mist to be supplied from the oil chamber 24 to the valve chamber 10 through the first passage 82. Further, the air containing the residual oil mist in the valve chamber 10 is sucked into the crank case 7 via the slit 74. Furthermore, additional oil mist is supplied directly to the crankcase 7 via the slit 74.

In accordance with the first embodiment, the oil mist is fed into the valve chamber 10 by both of the upward and downward motion of the piston 6; therefore, the mechanical parts in the valve chamber 10 are constantly lubricated. Further, during the upward motion of the piston 6, the oil mist is fed directly into the crankcase 7 from the oil chamber 24 and therefore, the piston 6 is well lubricated.

Further, in accordance with the first embodiment, since the second passage 54 consists of a tubular passage extending straight from the valve chamber 10 to the crankcase 7 in the downward direction, the oil in the liquid state collected in the valve chamber 10 can flow into the crankcase 7 through the second passage 54, thereby preventing the oil from being accumulated in the valve chamber 10.

Further, in accordance with the first embodiment, since the third passage 56 extends from a point in the vicinity of the bottom surface of the crankcase 7 in the horizontal direction and intersects with the first passage 52, the oil in the liquid state collected at the bottom of the crankcase 7 can be drained through the first passage 52 via the third passage 56 to prevent excess oil from being accumulated in the crankcase 7. That is, some oil is circulated to the valve chamber 10 by the rotation of the gears 34, 36, 38, 40 whereas some oil can be returned to the oil chamber 24 since the third passage 56 intersects with the first passage 52.

Further, in accordance with the second embodiment, the condensed oil mist in the vicinity of the slit 74 can be supplied to the valve chamber 10 and the crankcase 7. Therefore, the mechanical parts therein can be well lubricated.

Furthermore, in accordance with the second embodiment, even if the engine 70 is inclined considerably while the portable trimmer is manipulated, the oil stored in the oil reserving area 76 can be accommodated in one of or both of the oil relief areas 78 without flowing directly into the crankcase 7 through the slit 74. Therefore, even when the engine 70 is inclined considerably, the oil does not flow into the first opening 86.

Furthermore, in accordance with the second embodiment, since the first opening 86 is at the location directed toward the slit 74, the condensed oil mist created by the oil dipper 72 can be drawn into the slit 74 to lubricate the various mechanical parts of the engine 70.

Furthermore, in accordance with the second embodiment, the condensed oil mist created by the oil dipper 72 is sucked directly into the crankcase 7 via the slit 74 by the negative pressure created by the upward motion of the piston 6, the piston 6 and the other parts in the vicinity thereof can be lubricated thereby.

Furthermore, in accordance with the second embodiment, the oil in the liquid state in the valve chamber 10 returns to the crankcase 7 by gravity through the second passage 84 and the second opening 92, and further to the oil chamber 24 via the slit 74, thus preventing the excess oil from being accumulated in the valve chamber 10 and the crankcase 7.

Furthermore, in accordance with the second embodiment, since the slit 74 is provided in the inner wall 22 at the location where the oil surface does not reach, it prevents the oil from flowing into the slit 74.

It is to be noted that, in the second embodiment, since the first opening 86 is located next to the slit 74 as depicted in FIG. 4, the oil does not flow into the first opening 86 even if the engine 70 is inclined with respect to the axis of the crankshaft 8.

Furthermore, in the first and the second embodiments, since the first openings 58 and 86 are located at the lowest location at the bottom of the inner wall 22, the oil does not flow into the first openings 58 and 86 even if the engines 2 and 70 are inclined considerably to the left and right.

Furthermore, in the first and second embodiments, the first passages 52 and 82 are provided so as to extend to the valve chamber 10 through the area where the gears 34, 36, 38, 40 are provided, so the gears 34, 36, 38, 40 can be well-lubricated by the oil mist. Further, the oil and the oil mist can be delivered to the valve chamber 10 by the rotation of the gears 34, 36, 38, 40.

The present invention has thus been shown and described with reference to specific embodiments. However, it should be noted that the present invention is in no way limited to the details of the described arrangements but changes and modifications may be made without departing from the scope of the appended claims.

For example, in the first and second embodiments, the crankcase 7 and the oil chamber 24 are separated by the inner wall 22 which surrounds the connecting rod 32 in a U-shape provided on the left, right and lower sides thereof. However, the inner wall 22 may extend straight in the horizontal direction under the crankcase 7.

Furthermore, in the first and second embodiments, the oil mist feeding passages 50 and 80 extend thorough the area where the gears 34, 36, 38, 40 are provided. However, the oil mist feeding passages 50 and 80 may extend through the other areas where the other mechanical parts of the engine are mounted for lubrication.

Figure 3:
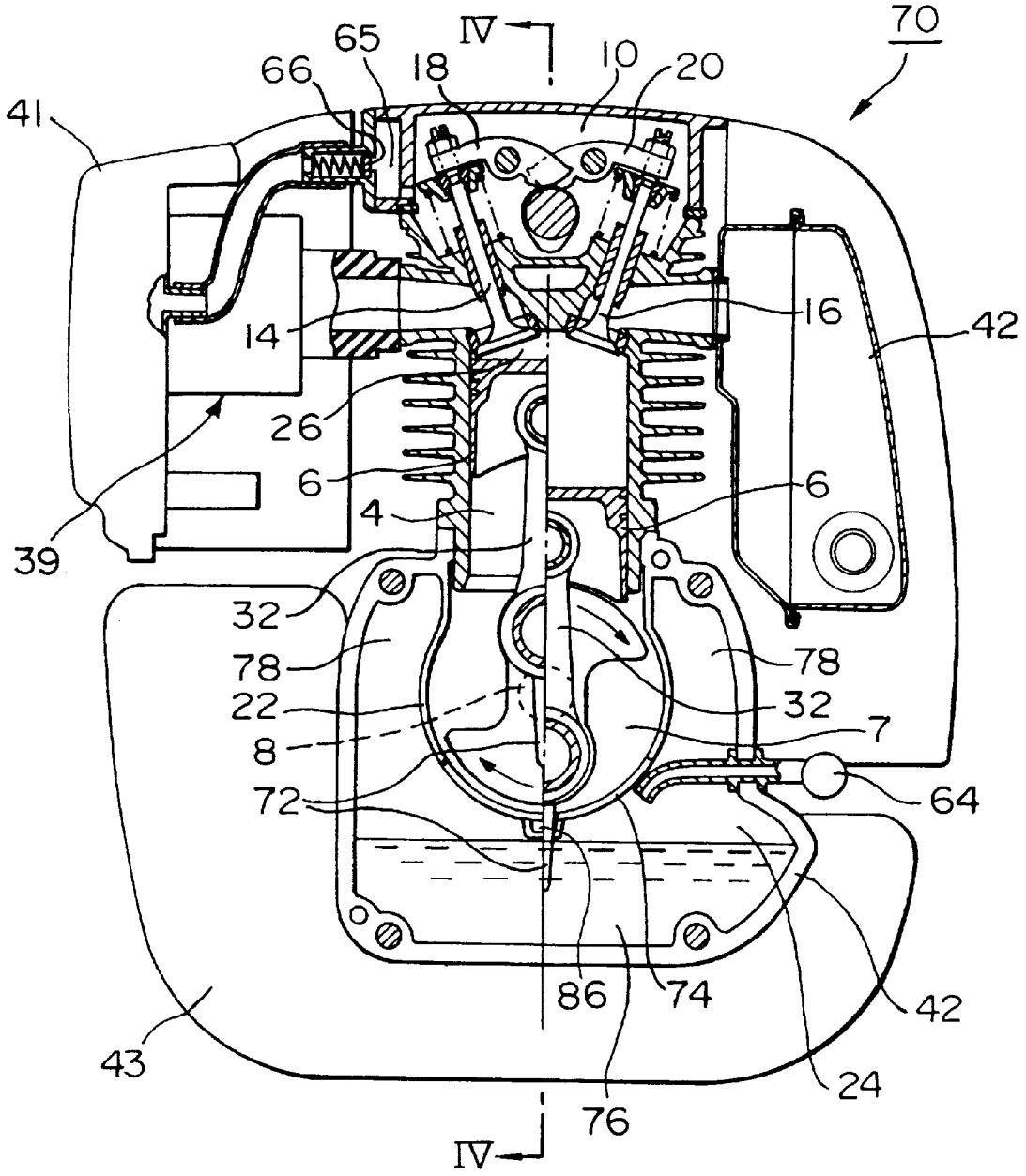
FIG. 3 is a cross-sectional view of a four-stroke internal combustion engine in accordance with a second embodiment of the present invention, with the piston shown at top dead center in the left half portion thereof, and with the piston shown at bottom dead center in the right half portion thereof.

Furthermore, in the second embodiment, the first check valve 64 shown in FIG. 3 can be omitted.

I claim:

1. A four-stroke internal combustion engine, comprising:

a connecting rod having a big end;

a valve chamber;

a crankcase;

an oil chamber;

a carburetor;

a bulkhead provided between said oil chamber and said crankcase and separating said oil chamber from said crankcase, said bulkhead having a slit formed therein;

an oil dipper provided at said big end of said connecting rod for agitating oil stored in said oil chamber and passing through said slit for lubrication;

an oil mist feeding passage extending from said oil chamber to said crank case via said valve chamber for supplying oil mist in said oil chamber;

said oil mist feeding passage having a first passage extending from said oil chamber to said valve chamber, and a second passage extending from said valve chamber to said crankcase;

said first passage having a first opening directed toward said slit in said oil chamber, said second passage having a second opening directed toward said crankcase and located at a point where it can be closed by said piston when it travels downwardly, a first check valve provided in said oil chamber and which allows atmospheric air to flow into said oil chamber; and a second check valve provided in said valve chamber and which allows gas to flow toward the carbureter.

2. A four-stroke internal combustion engine as recited in claim 1, wherein said bulkhead extends to surround said connecting rod on left, right and lower sides thereof to form an oil reserving area under said crankcase and oil relief areas on the right and left sides of said crankcase in said oil chamber, each of said oil relief areas has a volume of a size which enables storage of said oil in said oil reserving chamber so that the oil does not flow into said crankcase through said slit when said engine is rotated from an upright position toward an inclined position.

* * * * *